US008421697B2

(12) United States Patent
Yano

(10) Patent No.: US 8,421,697 B2
(45) Date of Patent: Apr. 16, 2013

(54) ANTENNA DEVICE AND RADAR APPARATUS

(75) Inventor: Koji Yano, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 4 days.

(21) Appl. No.: 12/940,856

(22) Filed: Nov. 5, 2010

(65) Prior Publication Data

US 2011/0109497 A1 May 12, 2011

(30) Foreign Application Priority Data

Nov. 6, 2009 (JP) ..... 2009-254844

(51) Int. Cl.
*H01Q 13/10* (2006.01)

(52) U.S. Cl.
USPC ..... 343/767; 343/768; 343/771; 343/778

(58) Field of Classification Search ..... 343/767–786
See application file for complete search history.

(56) References Cited

U.S. PATENT DOCUMENTS 2,573,746 A * 11/1951 Watson ..... 343/771
3,238,473 A * 3/1966 Salzberg ..... 333/113
4,243,990 A * 1/1981 Nemit et al. ..... 343/771
5,023,623 A 6/1991 Kreinheder et al.
5,177,496 A * 1/1993 Arimura et al. ..... 343/771
5,612,702 A * 3/1997 Kinsey ..... 342/427
6,377,204 B1 * 4/2002 Wurman et al. ..... 342/59
6,429,825 B1 8/2002 Martek

FOREIGN PATENT DOCUMENTS

FR 2136955 12/1972
JP 4-117803 A 4/1992
JP 2007-221585 A 8/2007
WO WO 2007/063298 A1 6/2007

OTHER PUBLICATIONS

Dunn D. S. et al, "Design of an eight element edge slot waveguide array antenna", SOUTHCON/94, Conference Record, Orlando, Mar. 29-31, 1994, New York, IEEE, US, pp. 278-281, XP01057967.

* cited by examiner

*Primary Examiner* — Timothy A Brainard
(74) *Attorney, Agent, or Firm* — Birch, Stewart, Kolasch & Birch, LLP

(57) ABSTRACT

This disclosure provides an antenna device, which includes a waveguide having a rectangular cross-section and formed with a plurality of slots in at least one side face thereof. The plurality of slots are arranged in a tube axis direction. At least one of the plurality of slots is formed with a predetermined inclination angle from a plane perpendicular to a tube axis direction of the waveguide.

16 Claims, 22 Drawing Sheets

ANTENNA DEVICE AND RADAR APPARATUS

CROSS-REFERENCE TO RELATED APPLICATION(S)

The application claims priority under 35 U.S.C. §119 to Japanese Patent Application No. 2009-254844, which was filed on Nov. 6, 2009, the entire disclosure of which is hereby incorporated by reference.

TECHNICAL FIELD

The present invention relates to an antenna device and a radar apparatus that uses the antenna device.

BACKGROUND

A radar apparatus radiates an electromagnetic wave from an antenna (antenna device), receives an echo signal from a reflecting body (e.g., target object), and detects a level of the echo signal to determine a distance and a direction from the antenna device to the target object. A radar image of the detected target object is normally displayed corresponding to the determined distance and direction on a radar screen centering on the position of the antenna device.

As the antenna devices for radar, an antenna device using a waveguide slot antenna is known (refer to JPA H04-117803). JPA H04-117803 discloses an array antenna which is configured so that a plurality of slots, each having a rectangular shape, are arranged in the waveguide. Such an array antenna realizes a radiation of the electromagnetic wave with a narrow beam width by equalizing phases of slots.

Generally, the waveguide slot antenna is often made to have an aperture distribution as the Chebyshev distribution to realize a narrow directivity beam. FIG. 1 shows the aperture distribution as the Chebyshev distribution. In FIG. 1, a side lobe level of the aperture distribution is shown as the Chebyshev distribution of −40 dB.

FIG. 2 shows the beam shape of the Chebyshev distribution shown in FIG. 1 (a radiation angle $\theta=90°$). As shown in FIG. 2, the Chebyshev distribution has a characteristic in which the narrowest beam width is always formed at a preset constant side lobe level. Such a beam configuration is preferable for such a radar apparatus.

However, for the target object displayed on the radar screen, although there are actually various sizes of the target objects, an actual size difference of the target objects may not be reflected to the radar image. Thus, if a ratio of the sizes of two or more echo images on the radar screen is different from the actual size ratio of the actual reflecting bodies, it may possibly prevent an operator from accurately recognizing the sizes of the target objects.

For example, as shown in FIG. 3, a substantial size difference of a reflecting body (ship) 501 and a reflecting body (ship) 502 is about five times of the other. However, as shown in FIG. 4, the ships may be displayed on a radar screen only as an echo image having a 2° width and an echo image having a 5° width, respectively. That is, in this case, only about 2.5-time difference appears on the radar screen. If a substantial size difference cannot be recognized by the operator from the difference of the echo sizes between a large reflecting body and a small reflecting body on the radar screen, he/she may possibly underestimate the sizes of the target objects.

A more specific example is given and described. The following is considered assuming that the target objects shown in FIG. 3 are a ship with a displacement of 5 tons and a length of 10 m, and a ship with a displacement of 100 tons and a length of 50 m, respectively. In this case, respective radar cross-sections (RCSs) are RCS=10 $m^2$ for the 5-ton displacement ship, and RCS=1000 $m^2$ for the 100-ton displacement ship. Supposing that a reflection intensity of the 5-ton displacement ship is relatively about 3 dB, a reflection intensity of the 100-ton displacement ship will be about 23 dB.

Here, if the electromagnetic wave having the aperture distribution as the Chebyshev distribution shown in FIG. 1 is used, a beam width of 3 dB is approximately 2°, while a beam width of 23 dB is approximately 5°. Therefore, as shown in FIG. 2, on the radar screen, the echo image having the 2° width and the echo image having the 5° width are displayed, respectively. Thus, although the substantial size difference is about five times of the other, they appear only with about 2.5 times in difference on the radar screen, as described above.

SUMMARY

The present invention provides an antenna device and a radar apparatus in which target objects detected are displayed by a size difference closer to an actual size difference on a radar display image.

According to an aspect of the invention, an antenna device includes a waveguide, having a rectangular cross-section and formed with a plurality of slots in at least one side face thereof, the plurality of slots being arranged in a tube axis direction. At least one of the plurality of slots is formed with a predetermined inclination angle from a plane perpendicular to a tube axis direction of the waveguide.

The antenna device includes the waveguide having the plurality of slots, and at least one of the slots inclines from a plane perpendicular to the tube axis direction of the waveguide. Thus, a phase distribution of the slots becomes nonlinear in the tube axis direction.

At least one pitch between adjacent slots in the tube axis direction may differ from pitches of other adjacent slots.

The pitches between adjacent slots in the tube axis direction may differ from the pitches of other adjacent slots on both sides of the waveguide in the tube axis direction with respect to the center of the waveguide in the tube axis direction.

The slots may include slots arranged at a first equal pitch, and slots arranged at a second pitch greater than the first pitch.

More than one of the slots may be inclined, and inclinations of the adjacent slots may be opposite with respect to the plane perpendicular to the tube axis direction.

More than one of the slots may be inclined, and the inclination angles of the slots may differ between the slot located at or near the center of the waveguide in the tube axis direction and the slot located at an end of the waveguide in the tube axis direction.

The inclination angle may be greater near the center of the waveguide than that near the end of the waveguide.

The slots may be formed in a side face that is narrower than the other side face.

The slots may be formed in a side face that is wider than the other side face.

The slots may include a plurality of slot array rows.

A beam of an electromagnetic wave discharged from the slots may be formed by uniting beams of aperture distributions having a plurality of side lobe levels different from each other, and the phase distribution of the slots is nonlinear in the tube axis direction.

The phase distribution may include a linear portion and a nonlinear portion in the tube axis direction.

A plurality of dielectrics with different dielectric constants may be provided to the waveguide corresponding to the respective slots from the outside.

A plurality of supplement waveguides with different widths in the tube axis direction may be provided to the waveguide corresponding to the respective slots from the outside.

According to another aspect of the invention, a radar apparatus includes an antenna device having a plurality of slots, at least one of the plurality of slots being formed at a predetermined inclination angle from a direction perpendicular to a tube axis direction of the waveguide, and at least one of pitches in the tube axis direction between adjacent slots differing from any of pitches of other slots, a reception circuit for detecting a position of a target object based on a level of an echo signal caused by an electromagnetic wave discharged from the antenna device, and a display screen for displaying the target object.

The antenna device includes the waveguide having the plurality of slots, and at least one of the slots inclines from a plane perpendicular to the tube axis direction of the waveguide. Thus, a phase distribution of the slots becomes nonlinear in the tube axis direction.

A beam of an electromagnetic wave discharged from the slots may be formed by uniting beams of aperture distributions having a plurality of side lobe levels different from each other, and the phase distribution of the slots is nonlinear in the tube axis direction.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

Hereinafter, several embodiments of an antenna device according to the present invention are described with reference to the appended drawings.

First Embodiment

Figure 5A:
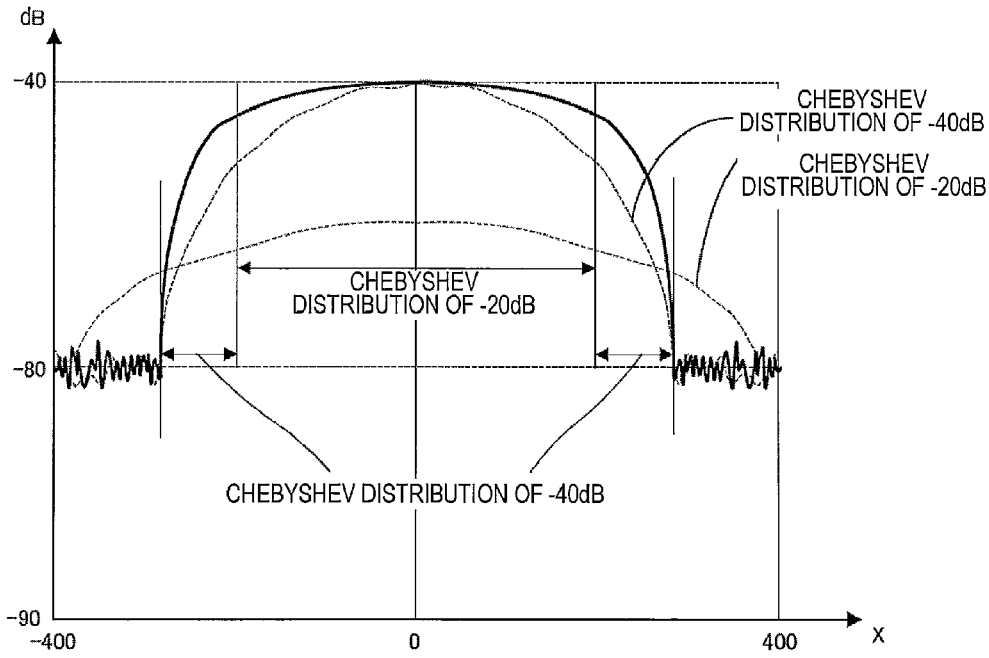
FIG. 5A is a chart showing an aperture distribution (a relation between an antenna slot position and an amplitude) of an antenna device according to an embodiment of the present invention.
Figure 5B:
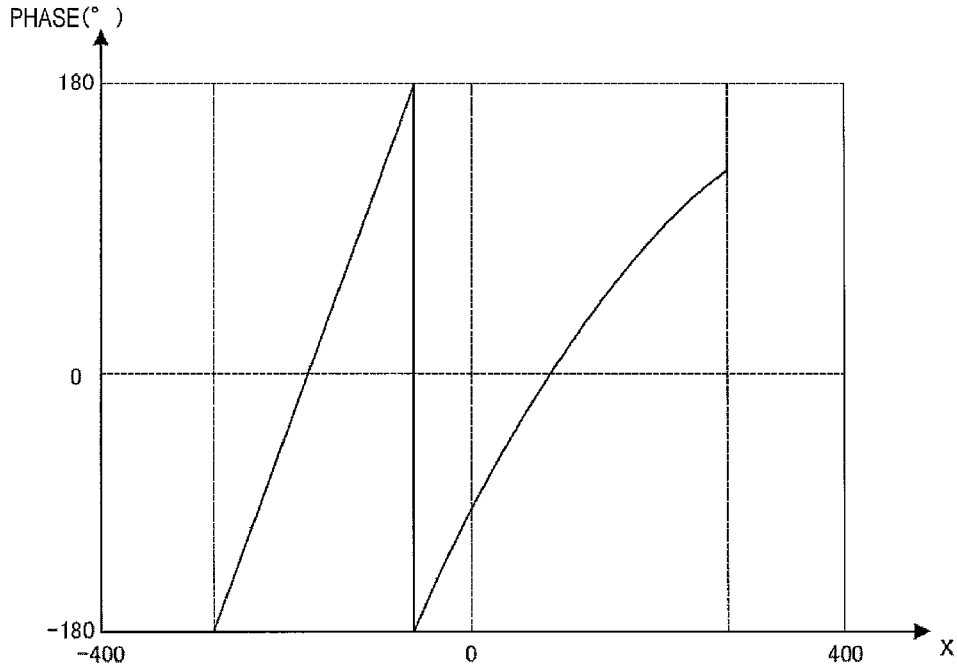
FIG. 5B is a chart showing a phase distribution of the aperture distribution shown in FIG. 5A.

FIG. 5A shows an aperture distribution (a relation between an antenna slot position and an amplitude) of the antenna device of this embodiment. FIG. 5B shows a phase distribution thereof.

As shown in FIG. 5A, the antenna device of this embodiment is configured such that the aperture distribution of slots of a waveguide has a characteristic in which two or more aperture distributions having a different side lobe level from each other are united. An electromagnetic wave beam discharged from the antenna device becomes what united beams of the aperture distributions having the different side lobe level from each other.

As shown in FIG. 5B, as for the antenna device of this embodiment, the phase distribution of the waveguide slots is nonlinear in a tube axis direction (for example, it becomes in a upwardly convex shape in this figure).

Figure 6:
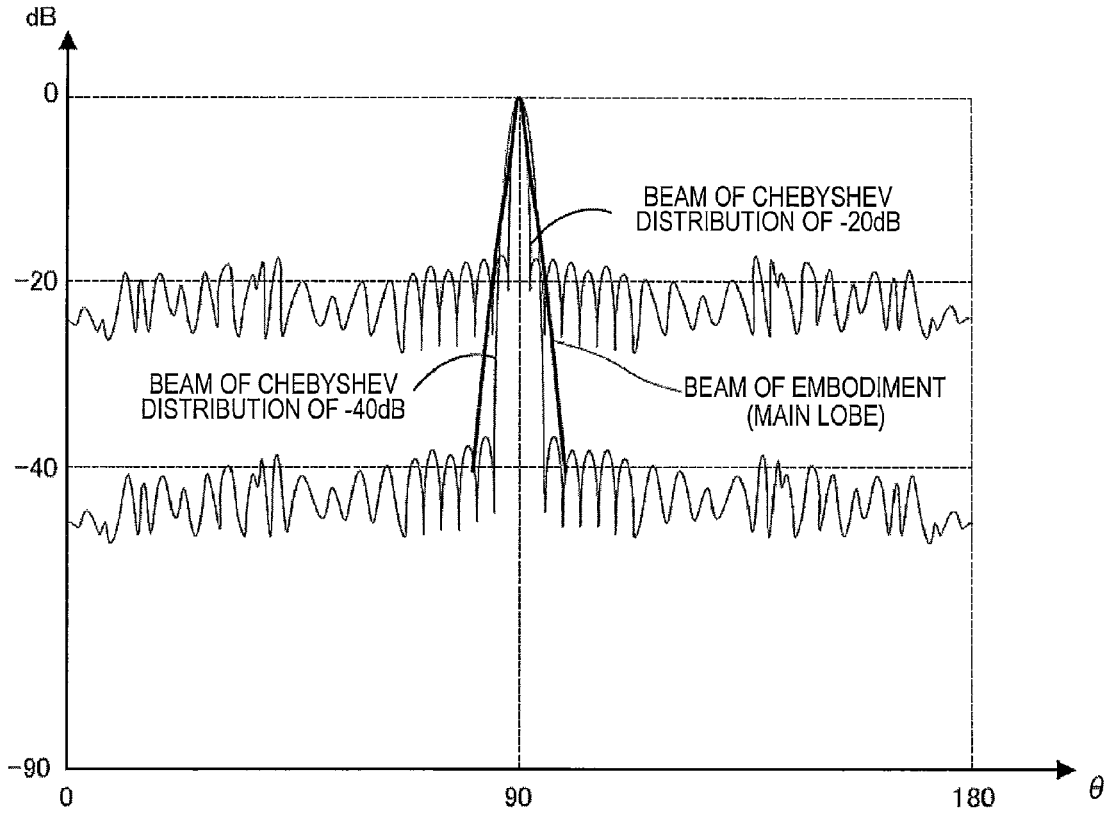
FIG. 6 is a shape of a beam radiated from the antenna device of this embodiment.

By providing such a phase distribution, as shown in FIG. 6, a beam that is formed by uniting two or more beams of the Chebyshev distributions in which side lobe levels differ from each other can be formed. In other words, the electromagnetic wave radiated from the antenna device has such a beam shape that the beam shape of the Chebyshev distribution of −20 dB where a side lobe level is high and a directivity of a main lobe is sharp and a beam shape of the Chebyshev distribution of −40 dB where a side lobe level is low and a directivity of a main lobe is blunt are united.

In the antenna device of this embodiment, the phase distribution is made to be nonlinear in the tube axis direction, and the first side lobes are included in the main lobe. For this reason, by providing the beam shape shown in FIG. 6, the main lobe having a shape such that the beam width is narrow near the center position of the waveguide ($\theta=90°$) and the beam width is wide at other positions can be formed. That is, the aperture distribution and the phase distribution have a feature in which a beam width narrower than the Chebyshev distribution can be realized at a similar side lobe level to that of the Chebyshev distribution.

Figure 7:
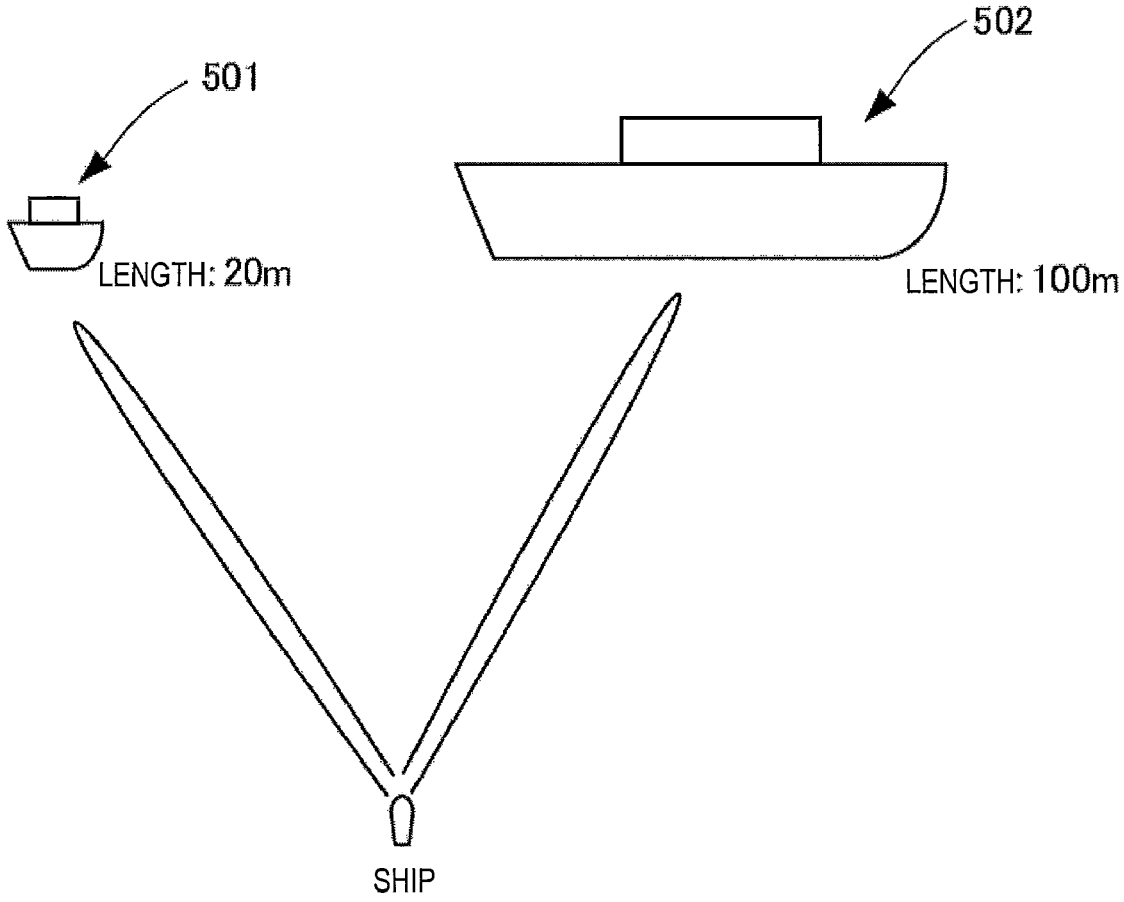
FIG. 7 is a schematic view showing a ship concerned, and two target objects having different sizes.
Figure 8:
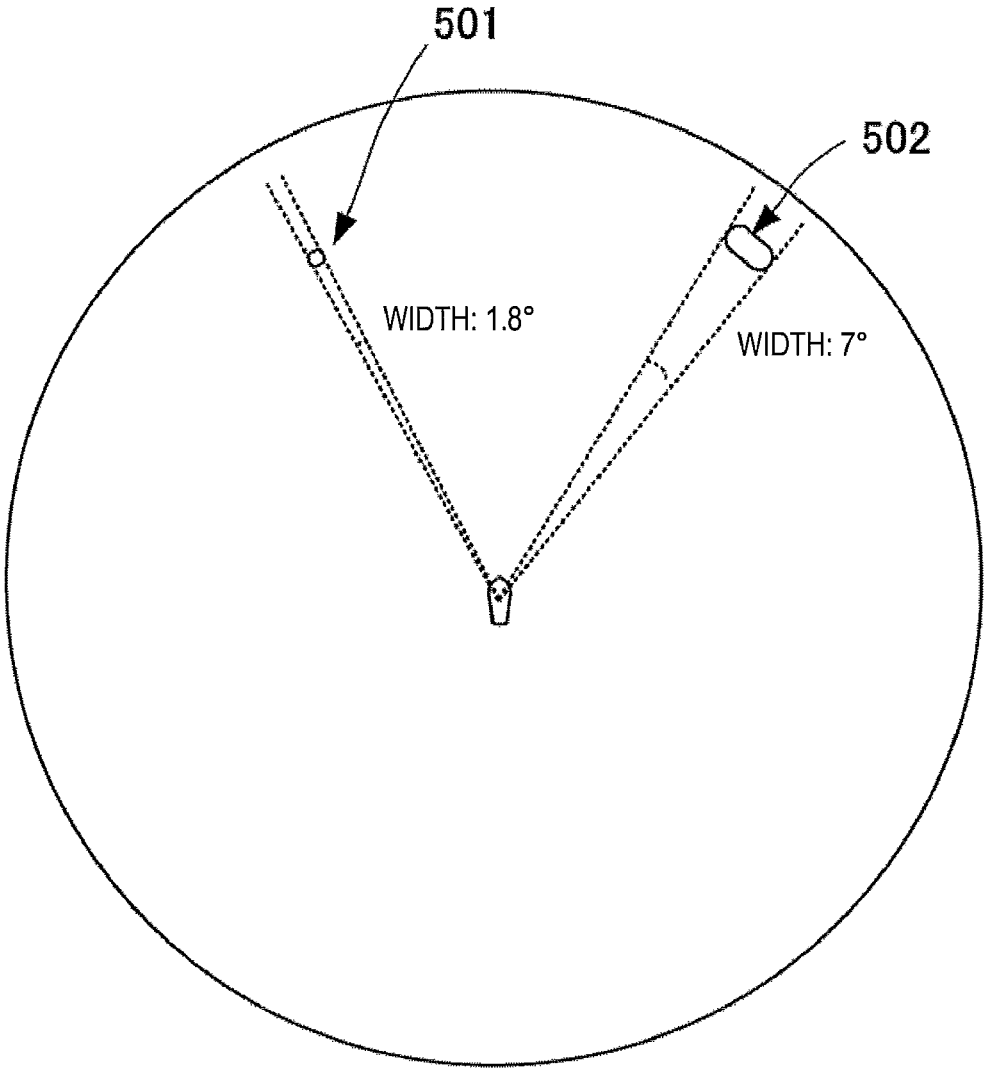
FIG. 8 is a schematic diagram showing echoes on a radar screen according to the antenna device of this embodiment.

As a result, as shown in FIG. 8, even if a beam width difference is large between a small reflecting body 501 and a large reflecting body 502 as shown in FIG. 7, echoes having a size difference close to the actual size difference can be displayed on a radar screen.

Next, a specific configuration to realize the above aperture distribution and phase distribution is described.

Figure 9:
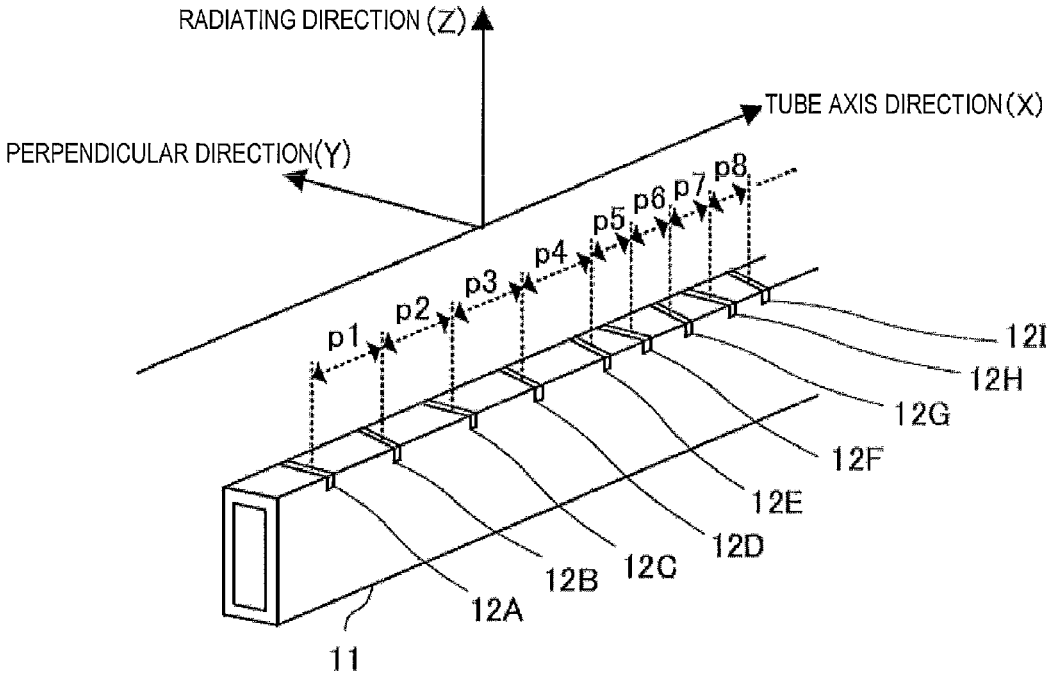
FIG. 9 is a perspective view showing a waveguide slot antenna of the antenna device of this embodiment.
Figure 10:
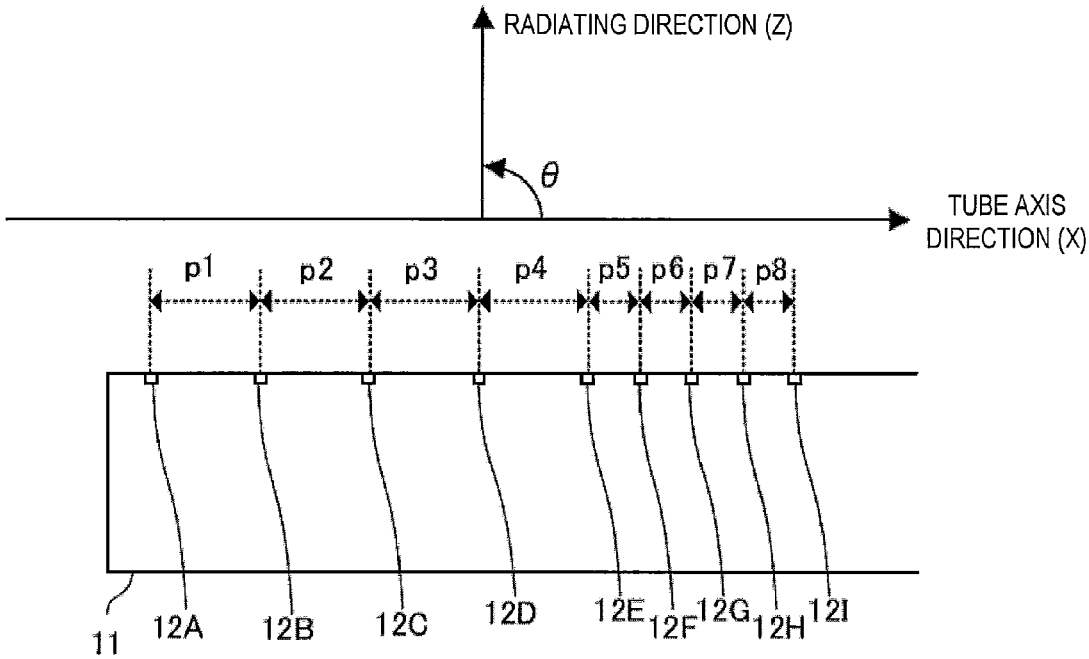
FIG. 10 is a side view of the waveguide slot antenna shown in FIG. 9, seen from a direction perpendicular to both a radiating direction and a tube axis direction of the electromagnetic wave.

FIGS. 9 and 10 are views showing a configuration of the waveguide slot antenna according to this embodiment. Specifically, FIG. 9 is a perspective profile view of the waveguide slot antenna, and FIG. 10 is a side view thereof when orienting its radiating direction of the electromagnetic wave (θ=90°) to an upward direction of the figure (Z-direction). Note that only a waveguide 11 for radiation is illustrated in FIGS. 9 and 10 and, thus, other components including a waveguide for introduction are omitted.

The waveguide slot antenna of this embodiment has the hollow (or a dielectric-contained) waveguide 11 having a rectangular cross-section, and two or more slots (in this example, nine slots 12A-121) are formed in an upper face (narrower surface side) of the waveguide 11. In this embodiment, although only some of the slots are shown (in this example, nine slots) for explanation purposes, a greater or less number of slots may also be formed in fact.

In the embodiment shown in FIGS. 9 and 10, the electromagnetic wave is introduced from a center position of the waveguide 11 (the center position in the left-and-right direction in the figures or the tube lengthwise direction), and the introduced electromagnetic wave is transmitted from the center position to the right side (X-direction) and the left side (negative X-direction) along the tube axis direction. Note that the electromagnetic wave may be introduced from either one of left and right ends of the waveguide 11.

Each slot slightly inclines from a perpendicular direction (Y-direction) seen from the upper face (a face from which the electromagnetic wave is radiated) of the waveguide 11. In this embodiment, adjacent slots are inclined oppositely from each other. Sequentially from the left side in the figures, the left-side slots 12A-12E are arranged at intervals of pitches p1 to p4, respectively, and in this embodiment, they are arranged at an equal interval (i.e., p1=p2=p3=p4). Furthermore, the right-side slots 12E-12I are arranged at intervals of pitches p5 to p8, respectively, and in this embodiment, they are arranged at an equal interval which is narrower than the above pitches p1 to p4 (i.e., p4>p5=p6=p7=p8).

The pitches between the respective adjacent slots shown in FIGS. 9 and 10 are exemplary, and at least one of the pitches may differ from the others. Similarly, for the inclinations of the slots, at least one of the slots may incline and the others may not.

Figure 11:
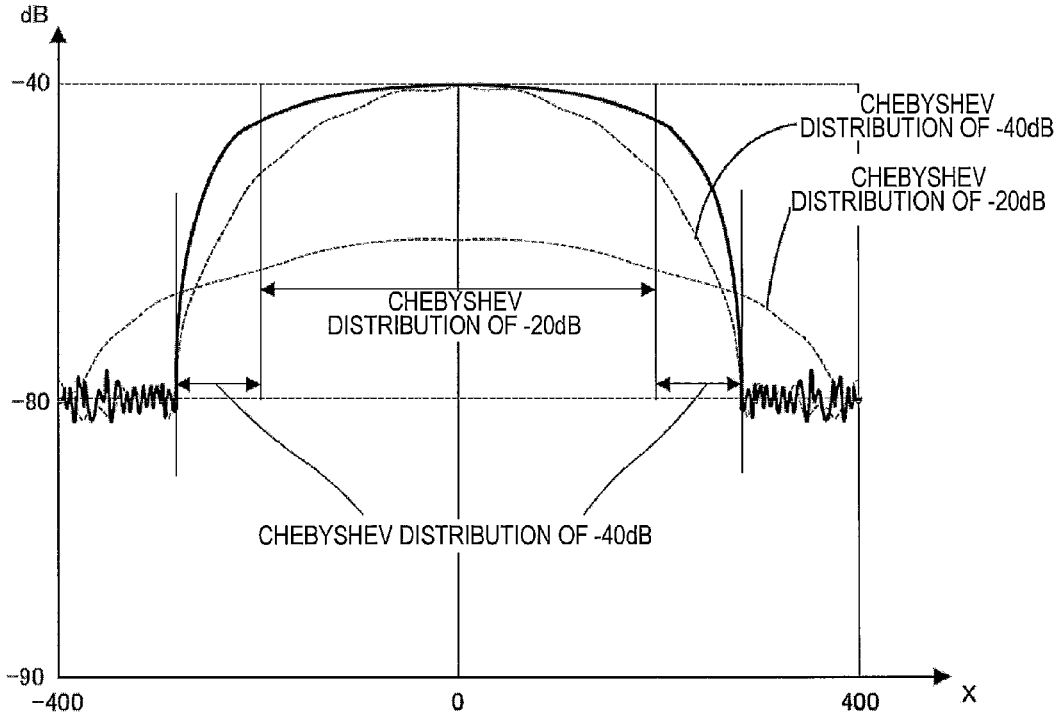
FIG. 11 is a chart showing an aperture distribution of the antenna device of this embodiment.

FIG. 11 is a chart showing an aperture distribution (a relation between an antenna slot position and an amplitude) where the center position in the tube axis direction of the waveguide 11 of this embodiment is set to the origin in the X-direction. As shown in FIG. 11, the waveguide slot antenna of this embodiment is configured to have a characteristic of the aperture distribution where two or more Chebyshev distributions having a different side lobe level from each other are united. That is, in this case, about ⅔ of the entire aperture distribution from the center position of the waveguide has a characteristic of the Chebyshev distribution of −20 dB, and the remaining about ⅓ of the aperture distribution has a characteristic of the Chebyshev distribution of −40 dB.

At each slot, the electromagnetic wave radiated (an electrical field strength) will be stronger as the inclination angle increases. Therefore, the aperture distribution can be arbitrarily set by adjusting the inclination angles of the slots. Generally, the inclination angles are the largest at the center position of the waveguide, and they are adjusted so that they become gradually smaller toward both the ends of the waveguide 11.

In the aperture distribution as shown in FIG. 11, for example, if electric power is supplied from one of the ends of the waveguide, the inclination angle(s) of the slot(s) may be made smaller on the power supply side, larger gradually over the center position, and again smaller at the other end. Here, a susceptance of each slot is set to zero. It is ideal to make the total amount of conductance of each slot is set to 1 so that the entire electromagnetic wave is irradiated from each slot. In addition to the above conditions, a cut depth to a wider face side of the waveguide is also taken into consideration to determine the inclination angle with respect to a direction perpendicular to the tube axis.

Figure 12:
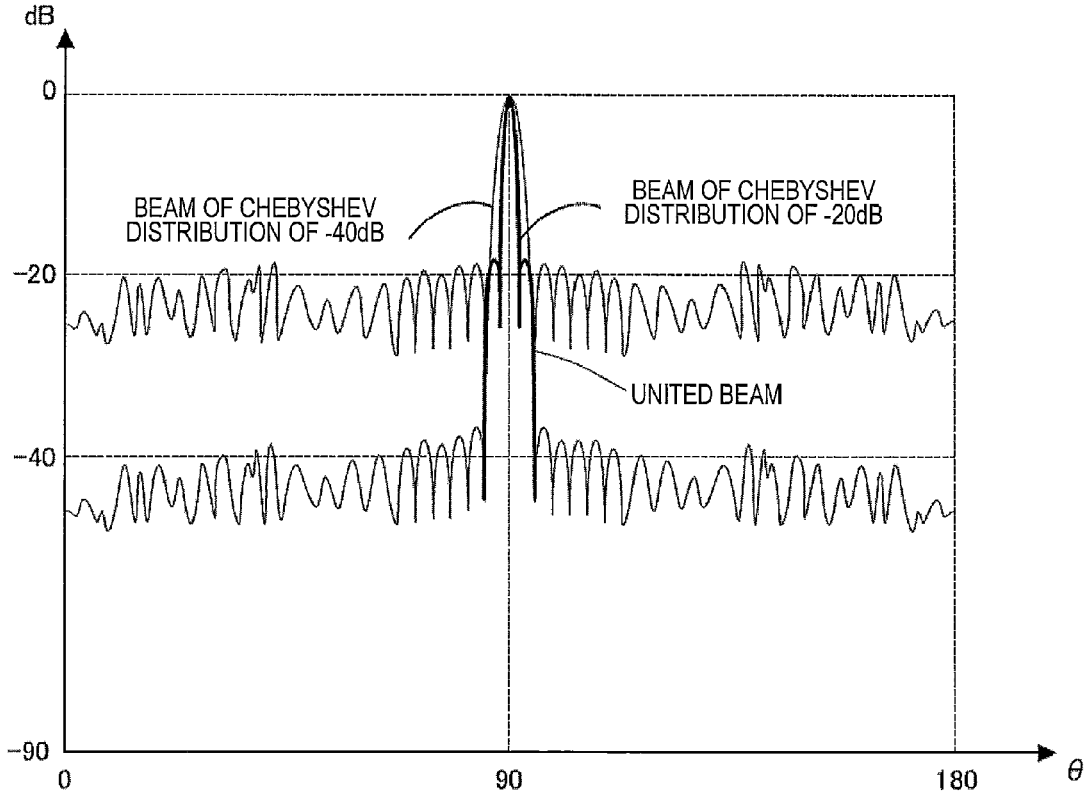
FIG. 12 is a chart showing a beam shape according to the waveguide slot antenna of the antenna device of this embodiment.

FIG. 12 shows, in the aperture distribution of this embodiment described above, a beam shape in the case that a phase distribution changes linearly in the tube axis direction, assuming that all the pitches between the slots are equal to each other. As described above, if about ⅔ of the entire aperture distribution from the center position of the waveguide is set to the Chebyshev distribution of −20 dB and the remaining about ⅓ of the aperture distribution is set to the Chebyshev distribution of −40 dB, the united beam has a main lobe and first side lobes of the Chebyshev distribution of −20 dB near the center position. In other positions, the united beam has a shape with side lobes of the Chebyshev distribution of −40 dB. That is, it has a beam shape formed by uniting a beam of the Chebyshev distribution of −20 dB where the side lobe level is high and the directivity of the main lobe is sharp, and a beam of the Chebyshev distribution of −40 dB where the side lobe level is low and the directivity of the main lobe is blunt.

The waveguide slot antenna of this embodiment has a narrow pitch part and a wide pitch part of the slots to bend a phase plane thereof in a convex shape in the middle of the entire length of the waveguide 11 (a phase change rate is changed with respect to the slot position), thereby the first side lobes can be included in the main lobe.

Figure 13:
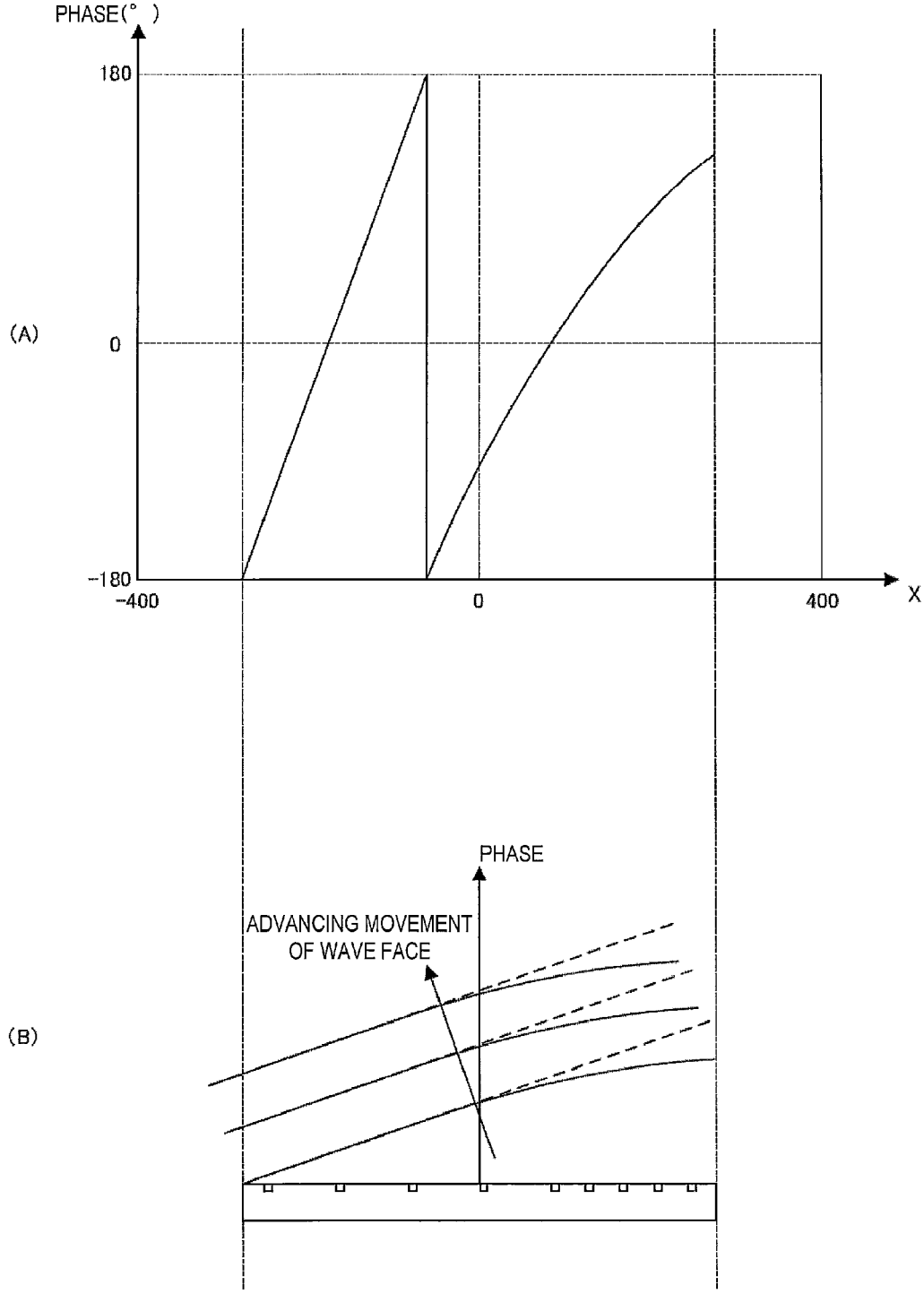
FIG. 13 is charts showing a phase distribution according to the antenna device of this embodiment.

FIG. 13 is charts showing a phase distribution of the waveguide having the slot arrangement described above. Specifically, (A) of FIG. 13 shows the phase distribution where the center position of the waveguide in the tube axis direction is set to the origin in the X-direction (X=0°). Meanwhile, (B) of FIG. 13 is a schematic diagram showing an advancing movement of a wave face. In this figure, in order to simplify the explanation, an example of the case where it is assumed that only the nine slots described above exist in the waveguide is shown.

In this embodiment, as shown in FIG. 13, because the pitches are equal to each other between the slots 12A to 12E, the phase changes linearly in the tube axis direction sequentially from the left side of the waveguide 11. Meanwhile, because the pitch becomes narrower on the right side from the slot 12E, the phase plane deviates from the straight line to reduce the phase change rate with respect to the slot position. Therefore, the entire phase distribution has the upwardly convex shape (becomes nonlinear in the tube axis direction, as shown in FIG. 5B).

Although an advancing direction of the wave face leans toward the left side from the radiating direction in the example shown in (B) of FIG. 13, it may be along the radiating direction, or may lean toward the right side. For example, in order to make the advancing direction of the wave face lean toward the right side, the phase change rate with respect to the slot position may be increased in the middle of the entire length of the waveguide 11. At any rate, it is preferred that the entire phase distribution may have the upwardly convex shape (a shape such that a differentiation component of the phase is lowered in the middle of the entire length of the waveguide 11).

The above shows the example in which the phase plane bends at the center position of the waveguide 11 from the radiating direction which is perpendicular to the tube axis direction (the pitches between the adjacent slots are different from each other on both sides with respect to the center position of the waveguide 11). However, the position at which the phase plane bends (position at which the pitch changes) is not limited to the center position of the waveguide.

Figure 14A:
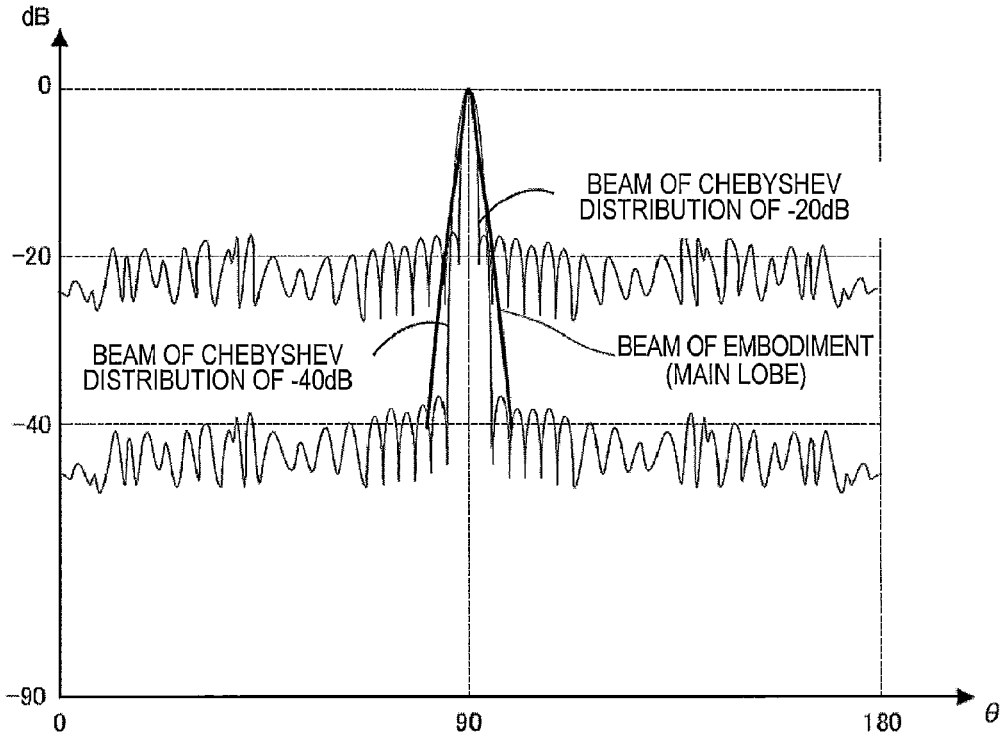
FIGS. 14A and 14B are charts showing a beam shape according to the antenna device of this embodiment.
Figure 14B:
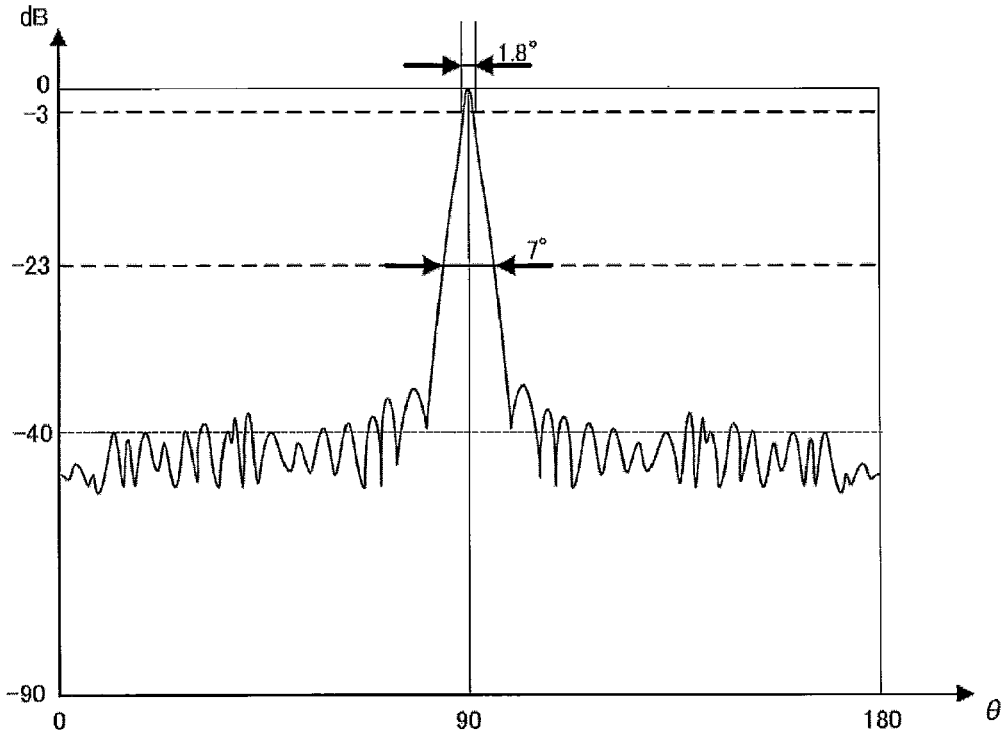

FIGS. 14A and 14B are charts showing the beam shape generated by the above phase distribution. Generally, when the interval of the slots is $\lambda g/2$ ($\lambda g$: a wavelength inside the waveguide tube 11), the phases of the slots are in agreement with each other in a plane parallel to the upper face of the waveguide. In this case, the phase distribution becomes uniform in the tube axis direction, and an electrical field strength becomes the strongest in a direction perpendicular to the waveguide upper face (i.e., the radiating direction).

If the interval of the slots is deviated from $\lambda g/2$ (and the intervals of the slots are made equal), the phases becomes in agreement with each other in a plane inclined from a plane parallel to the waveguide upper face. Therefore, if the slot interval is changed, the phase distribution changes in the tube axis direction (the inclination changes), and the electrical field strength becomes stronger at a position inclined from a direction perpendicular to the waveguide upper face.

In this embodiment, as shown in FIG. 14A, because the phase distribution has the upwardly convex shape (nonlinear), a portion at which the electrical field strength becomes strong is also slightly included in the surroundings of the wave face advancing direction. That is, the main lobe is made in a shape containing the first side lobes. In this case, although the main lobe shape has a narrow beam width at a 3 dB width, the beam width becomes wider at other widths (e.g., at a 20 dB width) to form a triangle beam shape. Therefore, the beam width at the 3 dB width is narrower than the beam shape of the conventional Chebyshev distribution of −40 dB, and the beam width becomes wider in other portions.

Next, the indication of the echo(es) by the radar apparatus to which the antenna device of this embodiment is applied is described, given with a more specific example.

Returning to FIG. 7, as for the radar apparatus provided with a reception circuit for processing an echo signal based on the electric wave discharged from the antenna device of this embodiment, a case where the two reflecting bodies with different sizes shown in the figure are displayed based on the echoes by the radar apparatus is described.

Here, the echo from the ship with a displacement of 5 t and a length of 10 m (RCS=10 $m^2$), and the echo from the ship with a displacement of 100 t and a length of 50 m (RCS=1000 $m^2$) are considered. Relatively, a reflection intensity of the 10 m-length ship is 3 dB, and a reflection intensity of the 50 m-length ship is 23 dB.

As shown in FIG. 14B, according to the main lobe of this embodiment, the beam width of 3 dB is about 1.8° and the beam width of 23 dB is about 7°. Therefore, as shown in FIG. 8, on the radar screen of the radar apparatus, an echo image having a width of 1.8° and an echo image having a width of 7° are displayed. Thereby, on the radar screen, they are displayed with about a quadruple difference.

Figure 1:
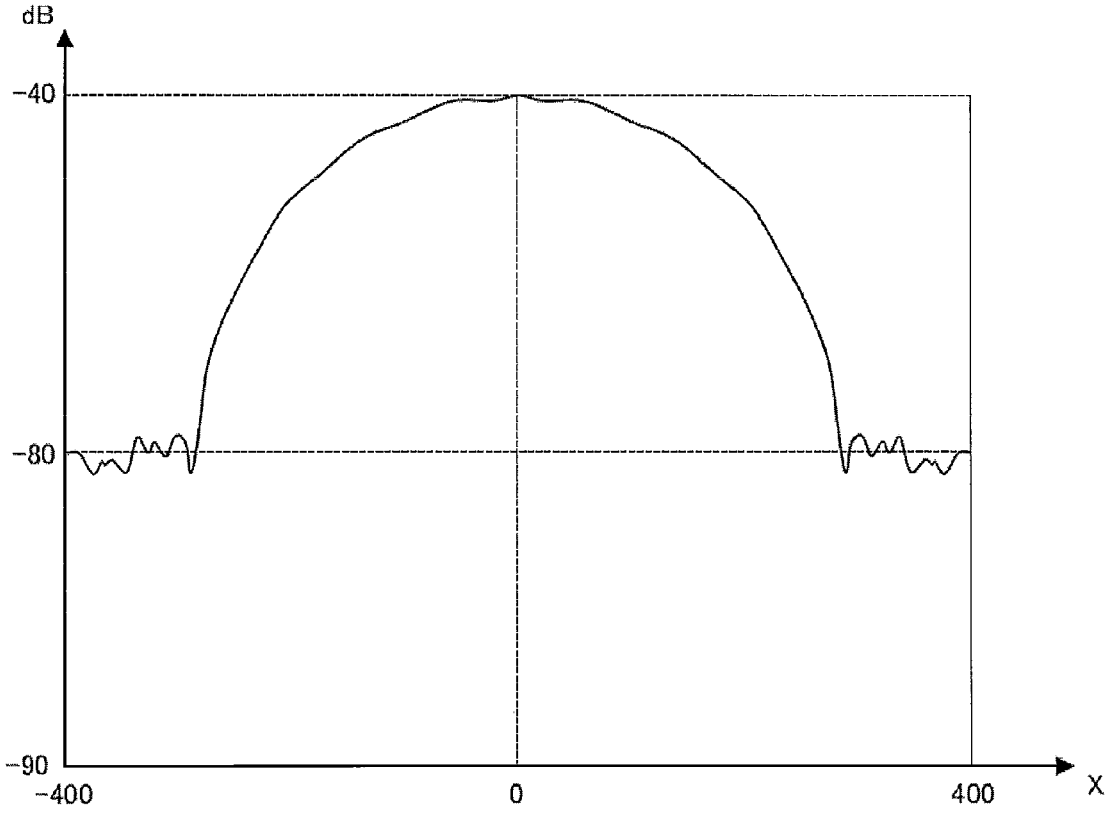
FIG. 1 (Related Art)
FIG. 1 is a chart showing an aperture distribution according to the Chebyshev distribution.
Figure 2:
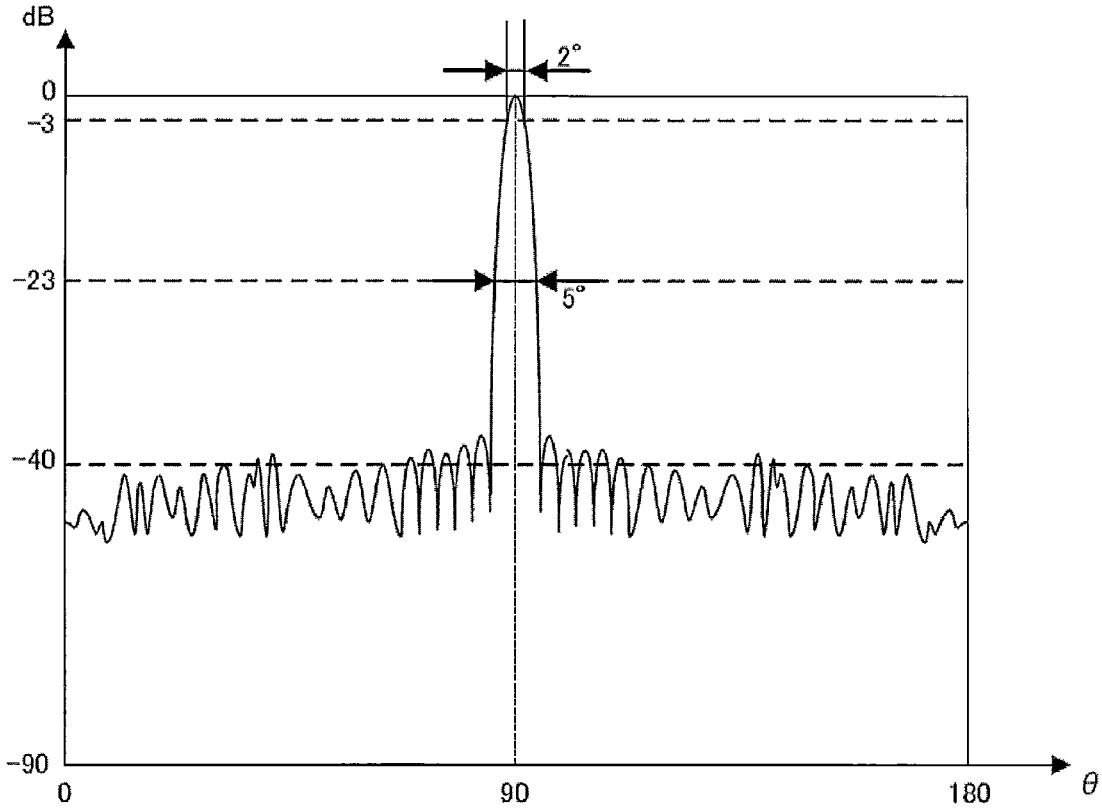
FIG. 2 (Related Art)
FIG. 2 is a shape of a beam radiated from an antenna device with the aperture distribution of FIG. 1.
Figure 3:
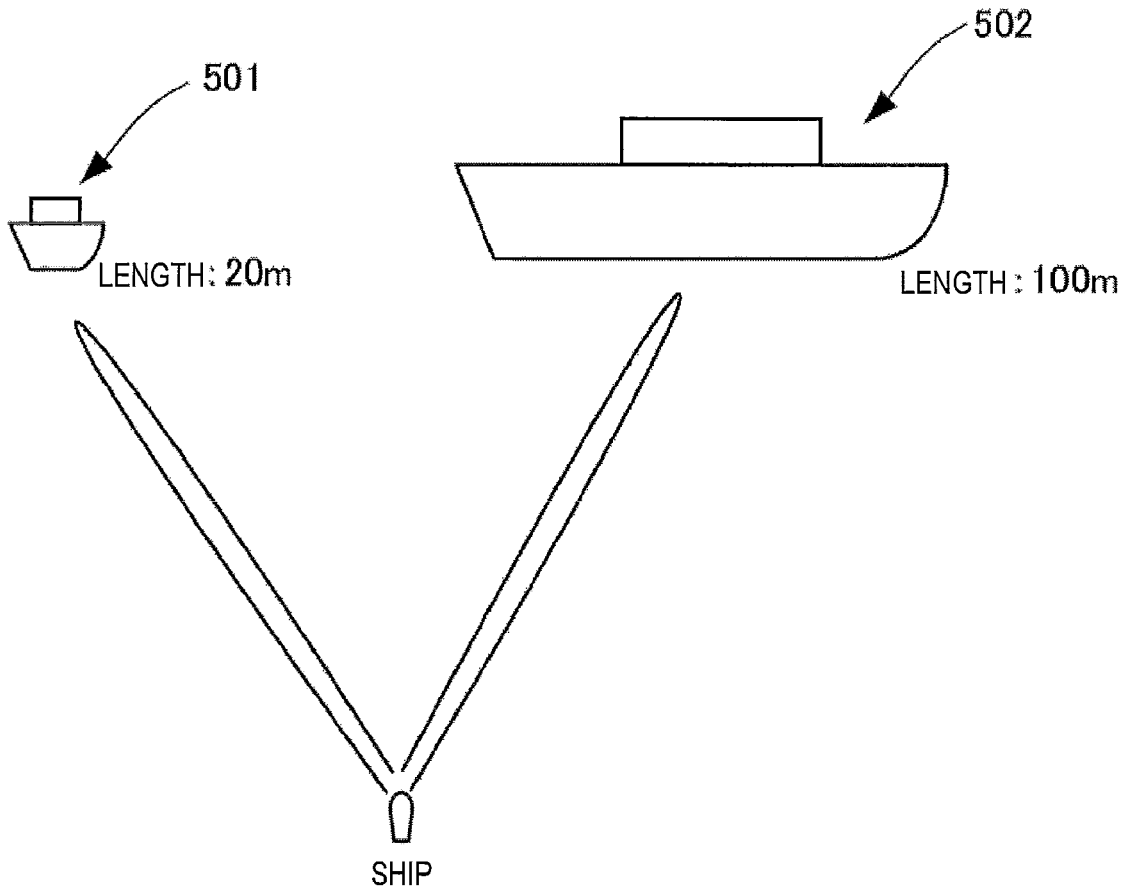
FIG. 3 (Related Art)
FIG. 3 is a schematic view showing a ship concerned, and two target objects having different sizes.
Figure 4:
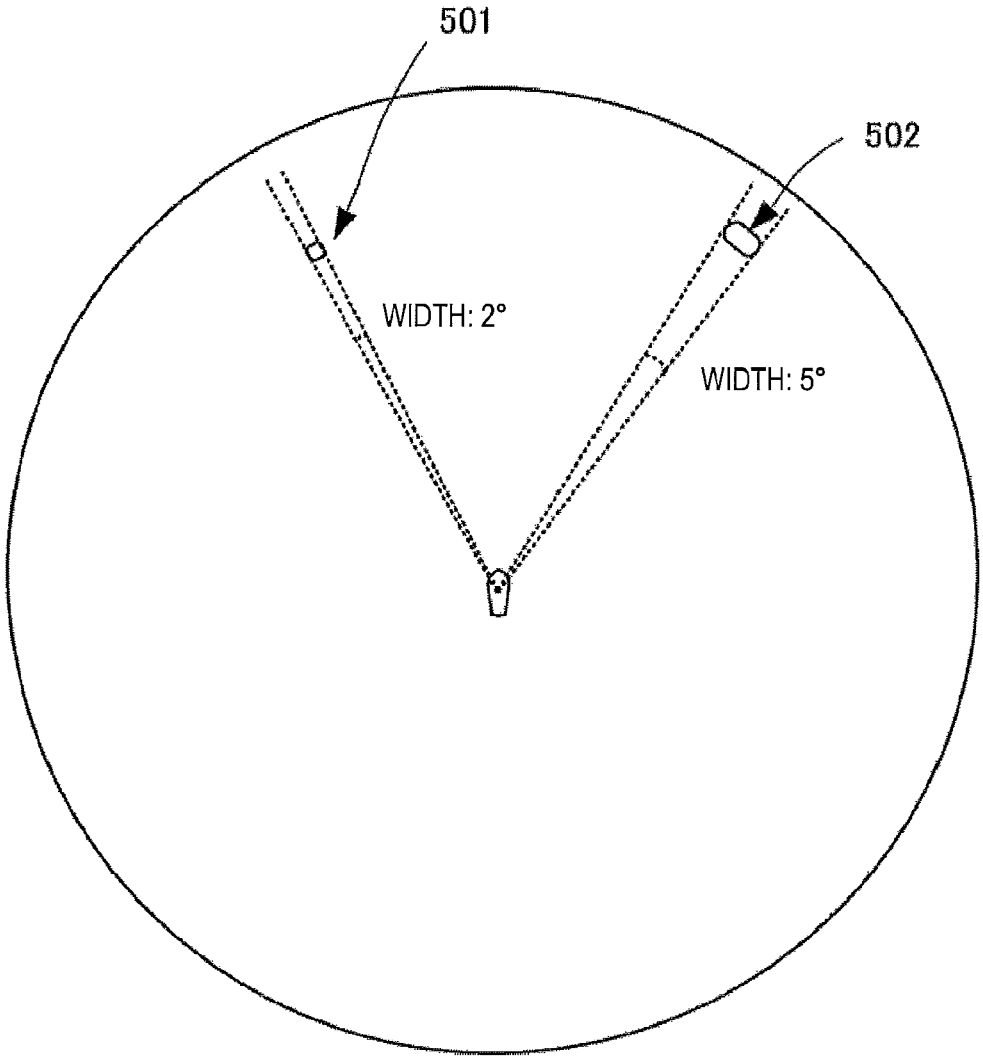
FIG. 4 (Related Art)
FIG. 4 is a schematic diagram showing echoes on a radar screen by a conventional antenna device, which has the aperture distribution of the Chebyshev distribution.

This allows an operator to recognize the echoes having a size difference closer to the actual size difference rather than the echo image of the radar apparatus provided with the conventional antenna device as shown in FIG. 4. Therefore, a possibility of underestimating the sizes of the reflecting bodies is reduced. This shows that the indication on the radar screen by this embodiment excels in the effect rather than that of the conventional antenna device.

Figure 15:
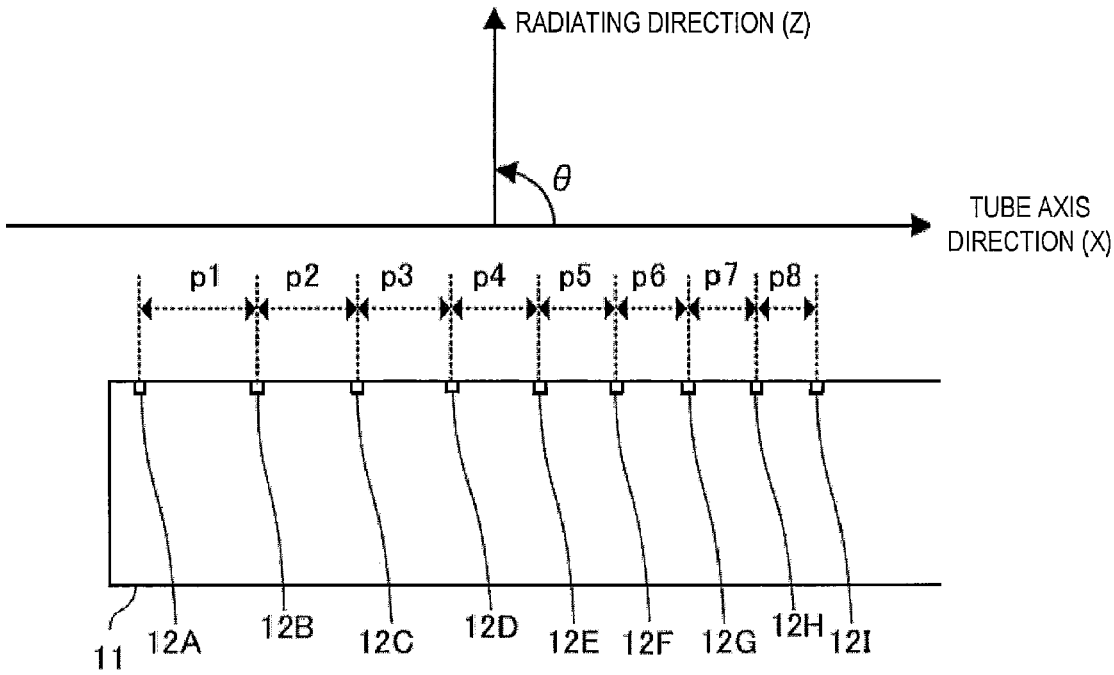
FIG. 15 is a side view of a waveguide slot antenna of an antenna device according to another embodiment of the invention, seen from a direction perpendicular to both a radiating direction and a tube axis direction of an electromagnetic wave.

The phase distribution is not limited to the example shown in FIG. 13 if the first side lobes can be included in the main lobe. For example, as shown in FIG. 15, the entire phase distribution may be made to have a nonlinear shape by making the slot pitches differ gradually in the tube axis direction throughout the entire length of the waveguide 11. In this way, even if the phase distribution has an upwardly concave shape, the first side lobes can be included in the main lobe.

Instead of providing the different slot pitches, two or more dielectrics with different dielectric constants may be provided to the slots (refer to the second embodiment). Alternatively, the phase distribution may be made in a nonlinear shape by providing two or more waveguides with different widths in the tube axis direction to the slots on the opening plane (refer to the third embodiment).

Second Embodiment

Next, another embodiment of the antenna device where two or more dielectrics with different dielectric constants are provided to the waveguide corresponding to the slots is described.

Figure 16:
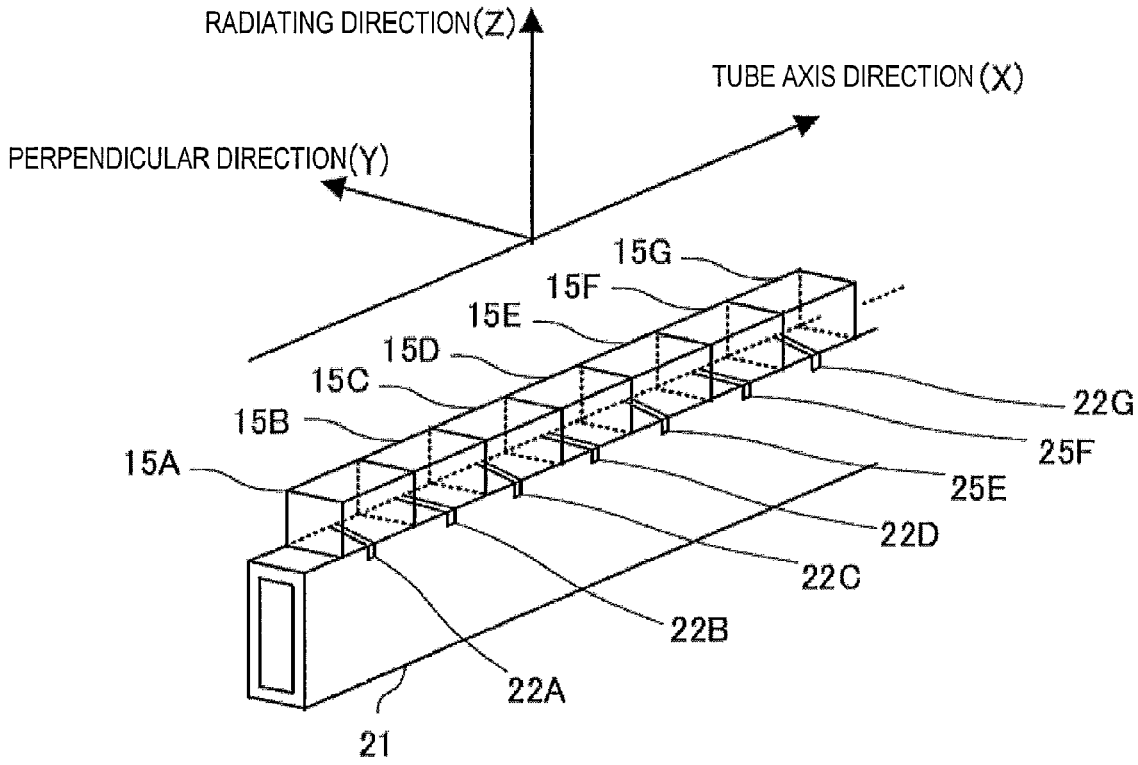
FIG. 16 is a perspective view showing a waveguide slot antenna of an antenna device according to another embodiment of the invention.
Figure 17:
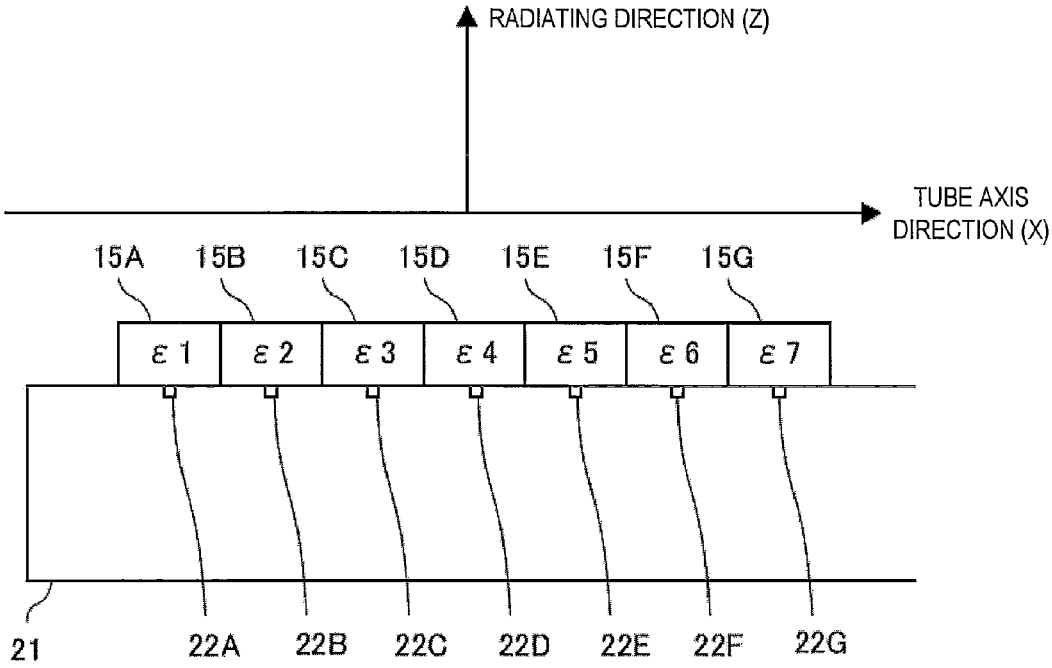
FIG. 17 is a side view of the waveguide slot antenna shown in FIG. 16, seen from a direction perpendicular to both a radiating direction and a tube axis direction of the electromagnetic wave.

FIG. 16 is a perspective view of the antenna device of this embodiment to which two or more dielectrics with different dielectric constants are provided to the waveguide 21 covering the slots from the outside. FIG. 17 is a view of the antenna device seen from a direction perpendicular to both of the tube axis direction and the radiating direction of the electromagnetic wave (i.e., the perpendicular direction in FIG. 16). As shown in these figures, without changing the inclinations and the pitches of the slots, a similar effect can be obtained by arranging materials having a different dielectric constant.

This waveguide slot antenna includes a hollow (or the dielectric-contained) waveguide 21 having a rectangular cross-section, and the waveguide 21 is formed with two or more slots (slots 22A-22G) in the upper face thereof. Although only seven slots are shown in FIGS. 16 and 17 for explanation purposes, a greater number of slots may be formed in fact.

Each slot shown in these figures also inclines from the perpendicular direction when one sees the waveguide 21 from its upper face (from the radiating direction), and the adjacent slots incline to the opposite direction from each other, respectively. Therefore, in the waveguide 21 of this example, the aperture distribution has the characteristic of the Chebyshev distribution of −20 dB for about ⅔ from the center position of the waveguide and the characteristic of the Chebyshev distribution of −40 dB for about the remaining ⅓.

Here, all the slots 22A-22G are arranged at an equal interval. Therefore, the phase distribution in the opening plane of the slots is linear in the tube axis direction. However, in this embodiment, the two or more dielectrics 15A-15G with different dielectric constants (dielectric constant: $\in 1$-$\in 7$, respectively) are provided to the waveguide 21 so as to cover the slots 22A-22G, respectively, to make the phase distribution to be nonlinear as a whole. By configuring as described above, the phase changes by providing the dielectrics with different dielectric constants for every slot, thereby the phase distribution of the upwardly convex shape is formed as shown in FIGS. 14A and 14B. Also in this embodiment, the dielectric(s) may be provided to one or some of the slots to bend the phase plane in the convex shape in the middle of the entire length of the waveguide.

Third Embodiment

Next, instead of arranging the materials having a different dielectric constant, another embodiment in which two or more supplement waveguides with different widths in the tube axis direction are arranged is described.

Figure 18:
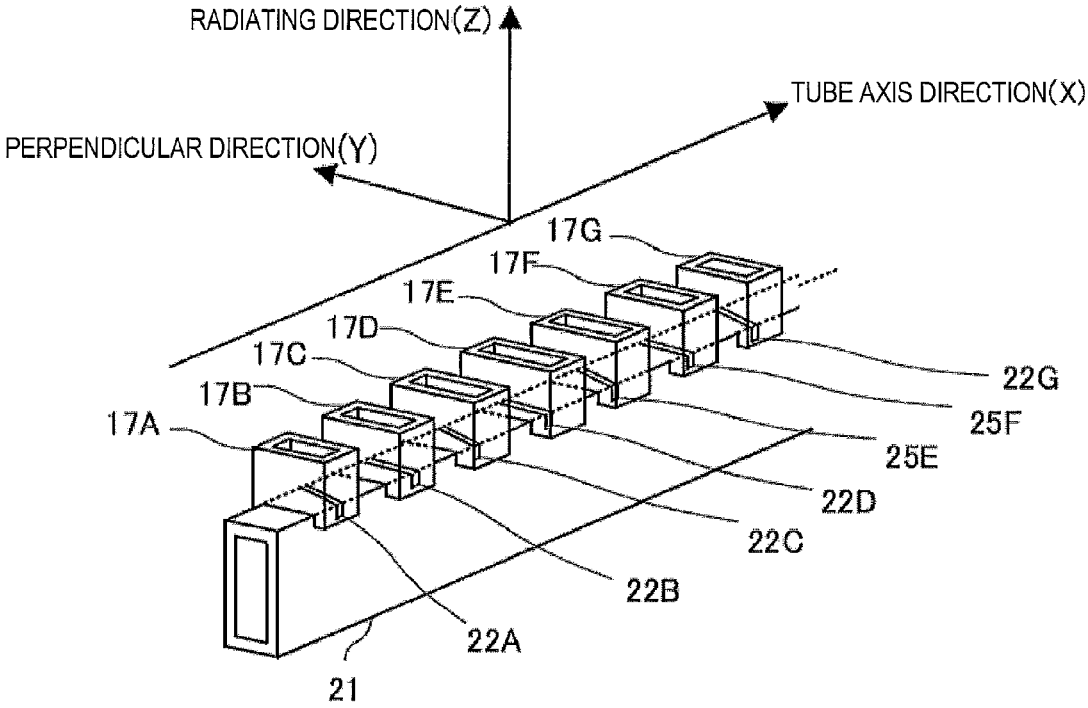
FIG. 18 is a perspective view showing a waveguide slot antenna of an antenna device according to another embodiment of the invention.
Figure 19:
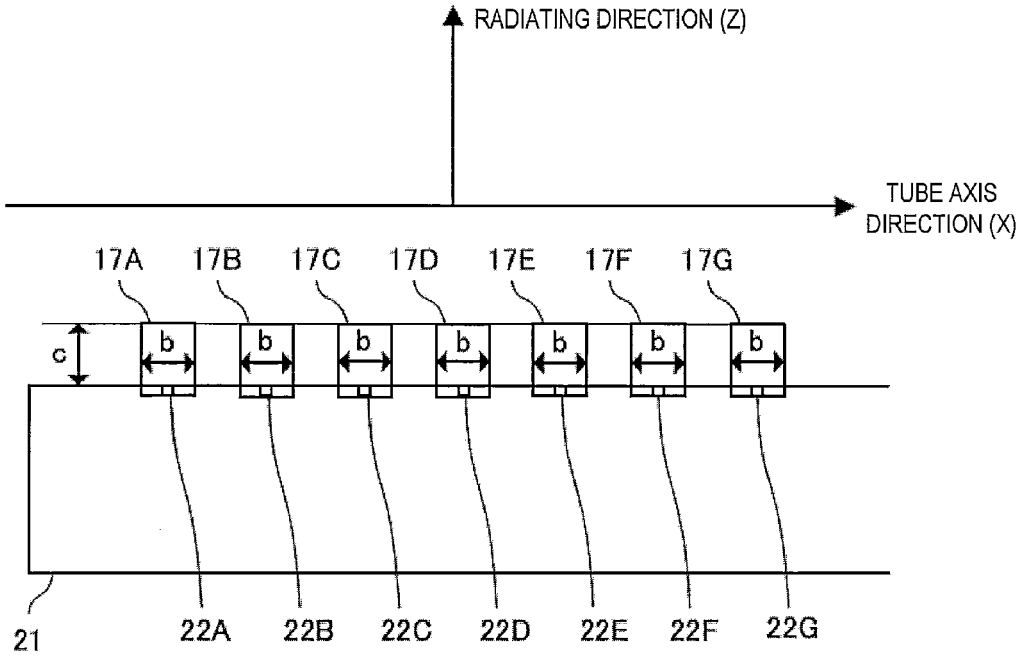
FIG. 19 is a side view of the waveguide slot antenna shown in FIG. 18, seen from a direction perpendicular to both a radiating direction and a tube axis direction of the electromagnetic wave.
Figure 20:
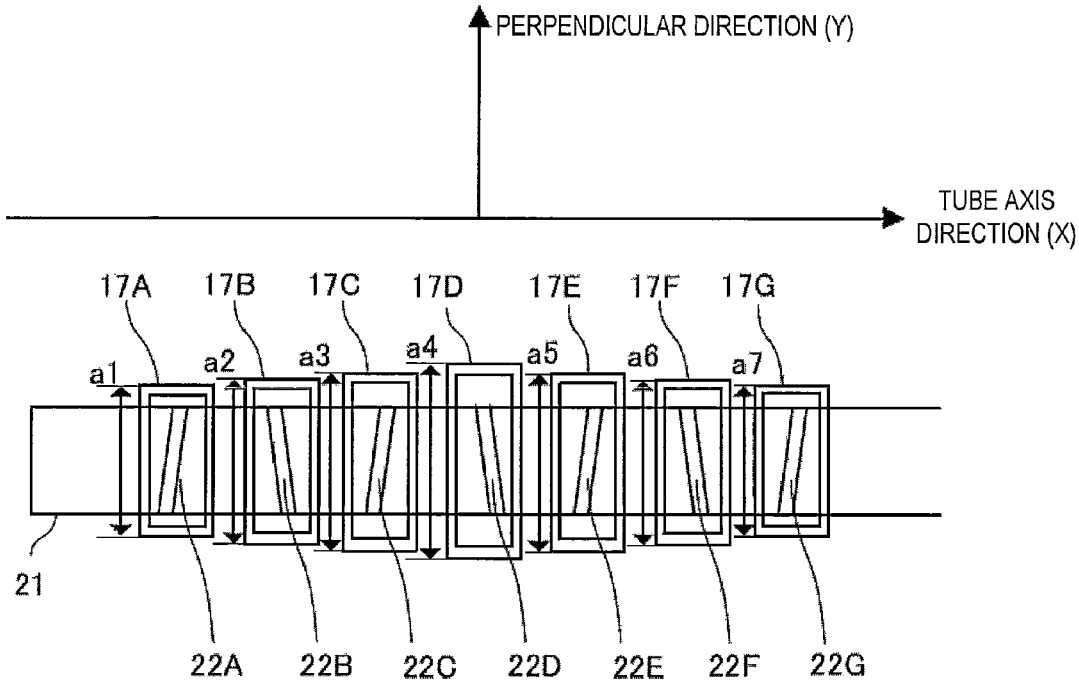
FIG. 20 is a elevational view of the waveguide slot antenna of this embodiment, seen from the radiating direction.

FIG. 18 shows a part of the antenna device of this embodiment to which two or more supplement waveguides with different widths in the tube axis direction are provided to the main waveguide 21 so as to surround the slots from the outside. FIG. 19 is a view of the antenna device shown in FIG. 18, seen from a direction perpendicular to the tube axis direction and perpendicular to the radiating direction of the electromagnetic wave (i.e., seen from the perpendicular direction). FIG. 20 is an elevational view of the antenna device, seen from the radiating direction of the electromagnetic wave. In these figures, only the waveguides for radiation are illustrated and the other components including a waveguide for introduction are omitted.

As described above, the waveguide slot antenna of this embodiment includes two or more supplement waveguides 17A-17G provided to the main waveguide 21 so as to surround the respective slots from the outside, instead of providing the dielectrics 15A-15G shown in FIGS. 16 and 17. Widths of the supplement waveguides 17A-17G in the tube axis direction are the same (width "b"), and their heights are also the same (height "c"). However, widths in a direction perpendicular to the tube axis direction (width "a") differ from each other. These widths are denoted as "a1" to "a7," respectively.

Specifically, from the supplement waveguide 17A toward the supplement waveguide 17D, the width "a" is greater sequentially (a1<a2<a3<a4), and from the supplement waveguide 17D toward the waveguide 17G, the width "a" is less sequentially (a4>a5>a6>a7). The wavelength λg inside the tube is often expressed by the following equation.

$$\lambda g = \frac{\lambda}{\sqrt{1-\left(\frac{\lambda}{2a}\right)^2}}$$

Therefore, the wavelength inside the tube is shorter gradually from the supplement waveguide 17A to the supplement waveguide 17D, and on the other hand, the wavelength inside the tube is longer gradually from the supplement waveguide 17D to the supplement waveguide 17G.

Because the ultimate transmission phase "p" can be expressed by p=c/λg, the phase plane bends in the convex shape in a range from the supplement waveguide 17D to the supplement waveguide 17G. That is, the phase distribution of the waveguide slot antenna as the whole is in the upwardly convex shape (nonlinear in the tube axis direction).

The waveguide slot antenna of this embodiment includes two or more supplement waveguides 17A-17G with different wavelengths inside the tube in the tube axis direction provided to the main waveguide 21 so as to surround the respective slots 22A-22G from the outside, thereby the phase distribution of the upwardly convex shape can be realized as shown in (A) of FIG. 13. Also in this embodiment, the supplement waveguide(s) may be provided only to some of the slots to bend the phase plane in the convex shape in the middle of the entire length of the waveguide.

Figure 21:
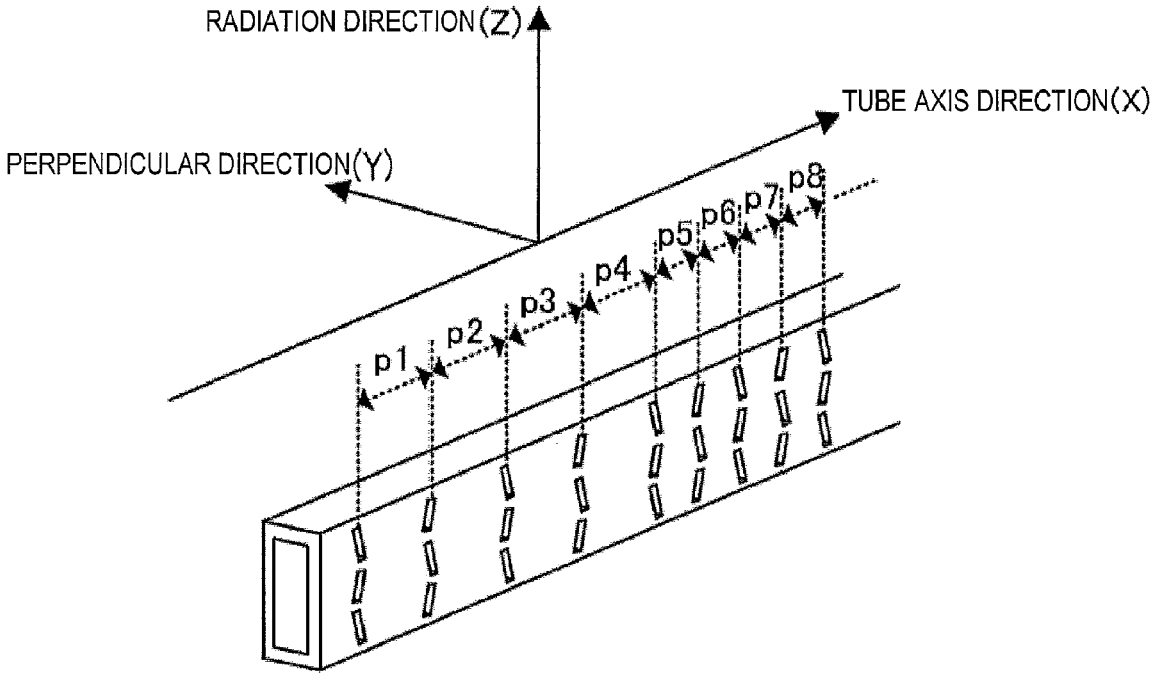
FIG. 21 is a perspective view showing a waveguide slot antenna according to another embodiment.

In any of the embodiments shown in FIGS. 9, 16 and 18, although the examples where two or more slots are provided in the upper face of the main waveguide 11 (narrower face side) are shown, the two or more slots may be provided to the front face of the main waveguide (wider face side). The two or more slots (slot array) are not limited to one row as described in the above embodiments, but two or more slot array rows may be arranged parallely to each other, as shown in FIG. 21. According to this configuration, a radiation of the electromagnetic wave in the perpendicular direction can be shaped more preferably.

Figure 22:
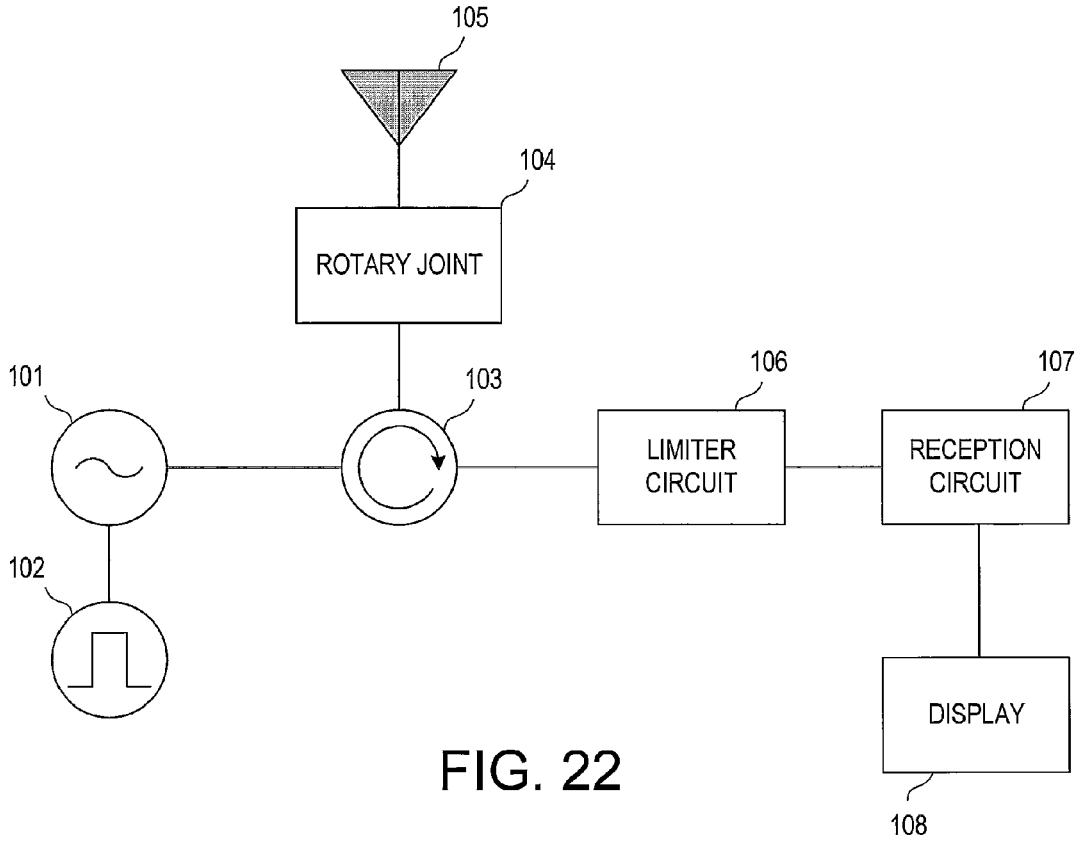
FIG. 22 is a block diagram of a microwave transceiver of a radar apparatus, as an example, to which an antenna device according to the present invention is applied.

FIG. 22 is a block diagram of a microwave transceiver of a radar apparatus, as an example, to which an antenna device according to the present invention is applied. The radar apparatus includes an antenna device according to the present invention, a reception circuit for detecting a position of a target object based on a level of an echo signal caused by an electromagnetic wave discharged from the antenna device, and a display screen for displaying the target object.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the teem is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. An antenna device, comprising:

a waveguide having a rectangular cross-section and formed with a plurality of slots in at least one side face thereof, the plurality of slots being arranged in a tube axis direction;

wherein at least one of the plurality of slots is formed with a predetermined inclination angle from a plane perpendicular to a tube axis direction of the waveguide, wherein at least one pitch between adjacent slots in the tube axis direction differs from pitches of other adjacent slots, and wherein the pitches between adjacent slots in the tube axis direction differ from the pitches of other adjacent slots on both sides of the waveguide in the tube axis direction with respect to the center of the waveguide in the tube axis direction, wherein a beam of an electromagnetic wave discharged from the slots is formed by uniting beams of aperture distributions having a plurality of side lobe levels different from each other, and a phase distribution of the slots is nonlinear in the tube axis direction.

2. The antenna device of claim 1, wherein the slots include slots arranged at a first equal pitch, and slots arranged at a second pitch greater than the first pitch.

3. The antenna device of claim 1, wherein more than one of the slots are inclined, and inclinations of the adjacent slots are opposite with respect to the plane perpendicular to the tube axis direction.

4. The antenna device of claim 1, wherein more than one of the slots are inclined, and the inclination angles of the slots differ between the slot located at or near the center of the waveguide in the tube axis direction and the slot located at an end of the waveguide in the tube axis direction.

5. The antenna device of claim 4, wherein the inclination angle is greater near the center of the waveguide than that near the end of the waveguide.

6. The antenna device of claim 1, wherein the slots are formed in a side face that is narrower than the other side face.

7. The antenna device of claim 1, wherein the slots are formed in a side face that is wider than the other side face.

8. The antenna device of claim 1, wherein the slots include a plurality of slot array rows.

9. The antenna device of claim 1, wherein the phase distribution includes a linear portion and a nonlinear portion in the tube axis direction.

10. An antenna device, comprising:

a waveguide having a rectangular cross-section and formed with a plurality of slots in at least one side face thereof, the plurality of slots being arranged in a tube axis direction;

wherein at least one of the plurality of slots is formed with a predetermined inclination angle from a plane perpendicular to a tube axis direction of the waveguide, wherein a plurality of dielectrics with different dielectric constants are provided to the waveguide corresponding to the respective slots from the outside.

11. The antenna device of claim 10, wherein a beam of an electromagnetic wave discharged from the slots is formed by uniting beams of aperture distributions having a plurality of side lobe levels different from each other, and a phase distribution of the slots is nonlinear in the tube axis direction.

12. The antenna device of claim 11, wherein the phase distribution includes a linear portion and a nonlinear portion in the tube axis direction.

13. An antenna device, comprising:

a waveguide having a rectangular cross-section and formed with a plurality of slots in at least one side face thereof, the plurality of slots being arranged in a tube axis direction;

wherein at least one of the plurality of slots is formed with a predetermined inclination angle from a plane perpendicular to a tube axis direction of the waveguide, and wherein a plurality of supplement waveguides with different widths in the tube axis direction are provided to the waveguide corresponding to the respective slots from the outside.

14. The antenna device of claim 13, wherein more than one of the slots are inclined, and the inclination angles of the slots differ between the slot located at or near the center of the waveguide in the tube axis direction and the slot located at an end of the waveguide in the tube axis direction.

15. The antenna device of claim 14, wherein the inclination angle is greater near the center of the waveguide than that near the end of the waveguide.

16. A radar apparatus, comprising:

an antenna device having a plurality of slots, at least one of the plurality of slots being formed at a predetermined inclination angle from a direction perpendicular to a tube axis direction of the waveguide, at least one of pitches in the tube axis direction between adjacent slots differing from any of pitches of other slots, and the pitches between adjacent slots in the tube direction differing from the pitches of other adjacent slots on both sides of the waveguide in the tube direction with respect to the center of the waveguide in the tube axis direction;

a reception circuit for detecting a position of a target object based on a level of an echo signal caused by an electromagnetic wave discharged from the antenna device; and a display screen for displaying the target object, wherein a beam of an electromagnetic wave discharged from the slots is formed by uniting beams of aperture distributions having a plurality of side lobe levels different from each other, and a phase distribution of the slots is nonlinear in the tube axis direction.

* * * * *